US007341500B2

(12) United States Patent
Horn et al.

(10) Patent No.: US 7,341,500 B2
(45) Date of Patent: Mar. 11, 2008

(54) GARMENT WITH LIFTING FEATURE

(75) Inventors: Lori Horn, New York, NY (US); Frank Scavetta, New York, NY (US); Pat Trow, New York, NY (US); Lorie Brown, New York, NY (US)

(73) Assignee: Victoria's Secret Stores Brand Management, Inc., Columbus, OH (US)

( * ) Notice: Subject to any disclaimer, the term of this patent is extended or adjusted under 35 U.S.C. 154(b) by 377 days.

(21) Appl. No.: 11/128,481

(22) Filed: May 13, 2005

(65) Prior Publication Data

US 2006/0253960 A1 Nov. 16, 2006

(51) Int. Cl.
*A41D 1/06* (2006.01)
*A41C 1/00* (2006.01)

(52) U.S. Cl. ..... 450/95; 450/97; 450/122; 450/12.3; 450/227

(58) Field of Classification Search ..... 2/227, 2/228, 238, 237, 221, 220, 61, 69, 79; 450/94, 450/95, 97, 101, 104, 117, 118, 122, 123, 450/124–156, 133
See application file for complete search history.

(56) References Cited

U.S. PATENT DOCUMENTS

| | | | | |
|---|---|---|---|---|
| 1,465,415 | A | | 8/1923 | Brunzel |
| 1,711,611 | A | | 5/1929 | Mock |
| 1,821,818 | A | | 9/1931 | Synder |
| 3,127,896 | A | | 4/1964 | Puliafico |
| 3,214,770 | A | | 11/1965 | Smith |
| 3,763,499 | A | | 10/1973 | Bartos et al. |
| 4,004,297 | A | | 1/1977 | Polack |
| 4,069,513 | A | | 1/1978 | Shiller et al. |
| 4,669,130 | A | | 6/1987 | Brown |
| 5,010,595 | A | | 4/1991 | Stradley |
| 5,052,058 | A | | 10/1991 | Mueller |
| 5,535,451 | A | | 7/1996 | Tassone et al. |
| 5,915,531 | A | * | 6/1999 | Hilpert et al. ..... 2/69 |
| 6,035,448 | A | * | 3/2000 | Thomson ..... 2/227 |
| 6,041,442 | A | | 3/2000 | Owen |
| 6,205,591 | B1 | * | 3/2001 | Wheeler et al. ..... 2/227 |
| 6,327,715 | B1 | | 12/2001 | Castiglione |
| 6,367,086 | B1 | * | 4/2002 | Woodard ..... 2/237 |
| 6,543,062 | B1 | | 4/2003 | Amsel et al. |

* cited by examiner

*Primary Examiner*—Gloria M. Hale
(74) *Attorney, Agent, or Firm*—Colucci & Umans; Angelo Notaro; Peter C. Michalos

(57) ABSTRACT

A garment with a seat area, a waist area and a crotch area, has a rear portion for defining the seat area and part of the waist and crotch areas, a front portion connected to the rear portion and defining part of the waist and crotch areas and an elastic panel assembly connected to the rear portion at least at the waist area and the crotch area. The panel assembly covers an inner surface of the rear portion over the seat area and comprises two sets of plural substantially vertical seams spaced symmetrically on opposite sides of a vertical center axis of the rear portion for defining at least two vertical elastic panels on each side of the center axis that are connected to the waist area, and an elastic lower panel such as a crotch panel or horizontal lower panel, connected to the crotch.

23 Claims, 14 Drawing Sheets

GARMENT WITH LIFTING FEATURE

FIELD AND BACKGROUND OF THE INVENTION

The present invention relates generally to the field of clothing construction and in particular to a new and useful construction for pants, trousers, jeans, shorts, underwear, hosiery, tights, swimsuits or any garment for covering the trunk portion of the body and having seat and crotch areas.

Clothing is a reflection of a person's image. Therefore, many people choose clothing which improves their appearance and image. Women often choose clothing to accentuate their natural features to project the image that they are in shape. This is especially true for bolstering confidence and self-esteem. However, most of these types of clothing are uncomfortable. Jeans with stretch denim or similar elastic fiber have recently become popular for providing a improved comfort and style. However, these types of jeans do not sufficiently accentuate the natural features of the wearer.

U.S. Pat. No. 6,543,062 discloses a pants garment that is provided with a unique cut and assembly that lifts and accentuates the wearer's buttocks. The pants garment is formed with a high back and a low front to better highlight and accentuate the buttocks of the wearer. Elastic panels along a front of the torso portion pull on the rear portions of the garment to better lift and accentuate the buttocks. A concave curved segment at the crotch joins a rearwardly disposed center seam and helps lift and accentuate the buttocks. In one construction, the pants garment is formed of a shape recovery material such as stretch denim. The leg portions have a single seam extending along an inner side so that the outer surface is seamless.

U.S. Pat. No. 5,535,451 discloses a pants garment comprising left and right panels with a rear portion joined along a rear curved line. The rear curved line is accentuated and rounded. The leg portions are narrowed to engage the thigh of a wearer to urge the buttocks of the wearer upwardly to fill out and conform to the rear curved line.

U.S. Pat. No. 3,214,770 to Smith discloses a pair of shorts having a conventional structure of left and right sides joined by left and right side seams, left and right legs and a waistband. The pair of shorts further contains an interior first panel of resilient fabric that extends around the right side of the garment from a central back seam to a front fly portion. Also, the shorts contain an interior second panel of resilient fabric that extends around the left side of the garment from the central back seam to the front fly portion. Both first and second panels extend vertically from the waistband to the crotch. Both panels are incorporated in the waistband, back and fly seam, but are otherwise unattached to the outer fabric of the shorts.

U.S. Pat. No. 6,041,442 to Owen discloses shorts having upper and lower portions and a liner formed of flexible material disposed within the upper garment portion. However, Owen '442 does not disclose any seams in the liner.

U.S. Pat. No. 4,069,513 to Shiller et al. discloses a pair of stretch slacks having a waistband into which an internal body hugging member is sewn. The body hugging member is made of a material such as a power net. The member is stitched to the slacks along a line which extends from the front center, along the crotch to the rear center. The power net may be made of panels sewn together particularly across the crotch. The configuration of the power net is such that individual leg holes are defined.

U.S. Pat. No. 4,004,297 to Polack and U.S. Pat. No. 4,669,130 to Brown both disclose a trouser construction in which the front part of the waistband is much lower than the back.

A product know as the "Something Vienus V-Hip Jeans" is know from Japan with a buttocks lifting feature. See, for example, the Internet URL http://www.v-hip.ip/index.html. Also see Japanese Utility Model Registration 3080399 of Jul. 4, 2001 and Japanese Patent Application No. 2002-63808 of Mar. 8, 2002.

A need remains for a figure enhancing garment that is structured to particularly sculpture the buttocks or seat area of the wearer.

SUMMARY OF THE INVENTION

It is an object of the present invention to provide a garment with a seat area, a waist area and a crotch area, which garment comprises a rear portion for defining the seat area and part of the waist and crotch areas, a front portion connected to the rear portion and defining an abdomen and part of the waist and crotch areas, and an elastic panel assembly connected to the inside of the rear portion at least at the waist area and the crotch area. The panel assembly comprises two sets of plural substantially vertical seams spaced symmetrically on opposite sides of a vertical center axis of the rear portion for defining at least two vertical elastic upper panels on each side of the center axis that are connected to the waist area, and an elastic lower panel connected to the crotch area.

A further object of the invention is to provide such a garment wherein the rear and front portions are connected to each other at a pair of opposite side seams, the elastic panel assembly having opposite side edges connected to the respective opposite side seams and a pair of lower edges on opposite sides of the center axis that are free and are not connected to the rear portion of the garment.

According to a still further object of the invention, each set of substantially vertical seams of the garment contain two seams.

A further object of the invention is to provide a garment where each substantially vertical seam is curved and the seams in each set are curved in the same direction and opposite to a direction of curvature of the seams of the set on the opposite side of the center axis, or in opposite directions within each set or wherein the seams in each set diverge from each other in a direction away from the waist area.

A garment according to invention is also provided wherein the panel assembly includes at least one lower and substantially horizontal elastic panel connected by at least one substantially horizontal seam to a lower end of at least one of the vertical elastic upper panels.

A garment according to the invention may also have the lower panel connected to at least one of the vertical elastic upper panels on each side of the center axis at a substantially horizontal seam.

Another object of the invention is to provide a garment wherein the elastic panel assembly further comprises two sets of plural substantially vertical lower seams spaced symmetrically on opposite sides of a vertical center axis of the rear portion for defining at least two vertical elastic lower panels on each side of the center axis that are connected to, and extend below the vertical elastic upper panels.

The garment of the invention may also include a front elastic panel assembly connected to the rear elastic panel assembly at opposite sides of the garment and extending over at least part of an inner surface of the front portion of the garment.

The elastic panel assembly of the present invention is designed with a power fabric to enhance the buttocks by lifting and shaping. Because the elastic panel assembly is attached to the garment at least at the crotch and waist, hanging free at the lower edges around the legs, the elastic panel assembly subtly enhances the shape of the buttocks as it lifts and supports. The elastic panel raises the hips, rounds and holds the buttocks, and tightens the thighs for a firmer and smoother appearance.

These and other features of the present invention are disclosed in greater detail later in this disclosure and the various features of novelty which characterize the invention are pointed out with particularity in the claims annexed to and forming a part of this disclosure.

For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
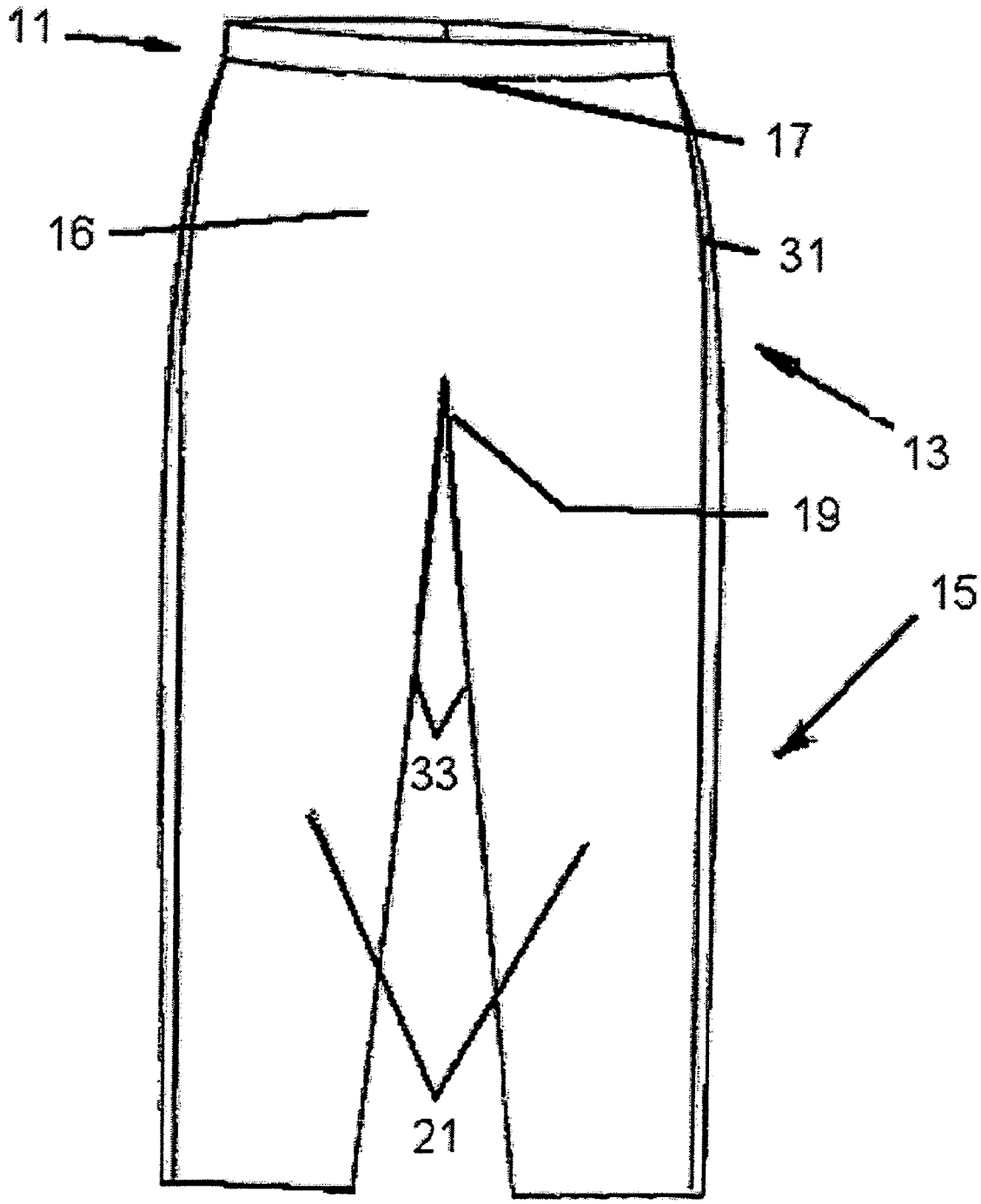
FIG. 1 is a rear view of the garment of the present invention.

Referring now to the drawings, in which like reference numerals are used to refer to the same or similar elements, FIG. 1 shows the rear of a garment 11 that includes an upper portion generally designated 13 and a lower portion generally designated 15. The upper portion 13 of the rear of the garment includes a seat area 16, a waist 17, and a crotch 19. The lower portion of the rear of the garment comprises the rear portion of a pair of legs 21. The garment 11 of the present invention is a type of clothing that is worn on the lower portion of the body, such as pants, jeans, shorts, underwear, hosiery, tights, swimsuits, or similar clothes.

Figure 2:
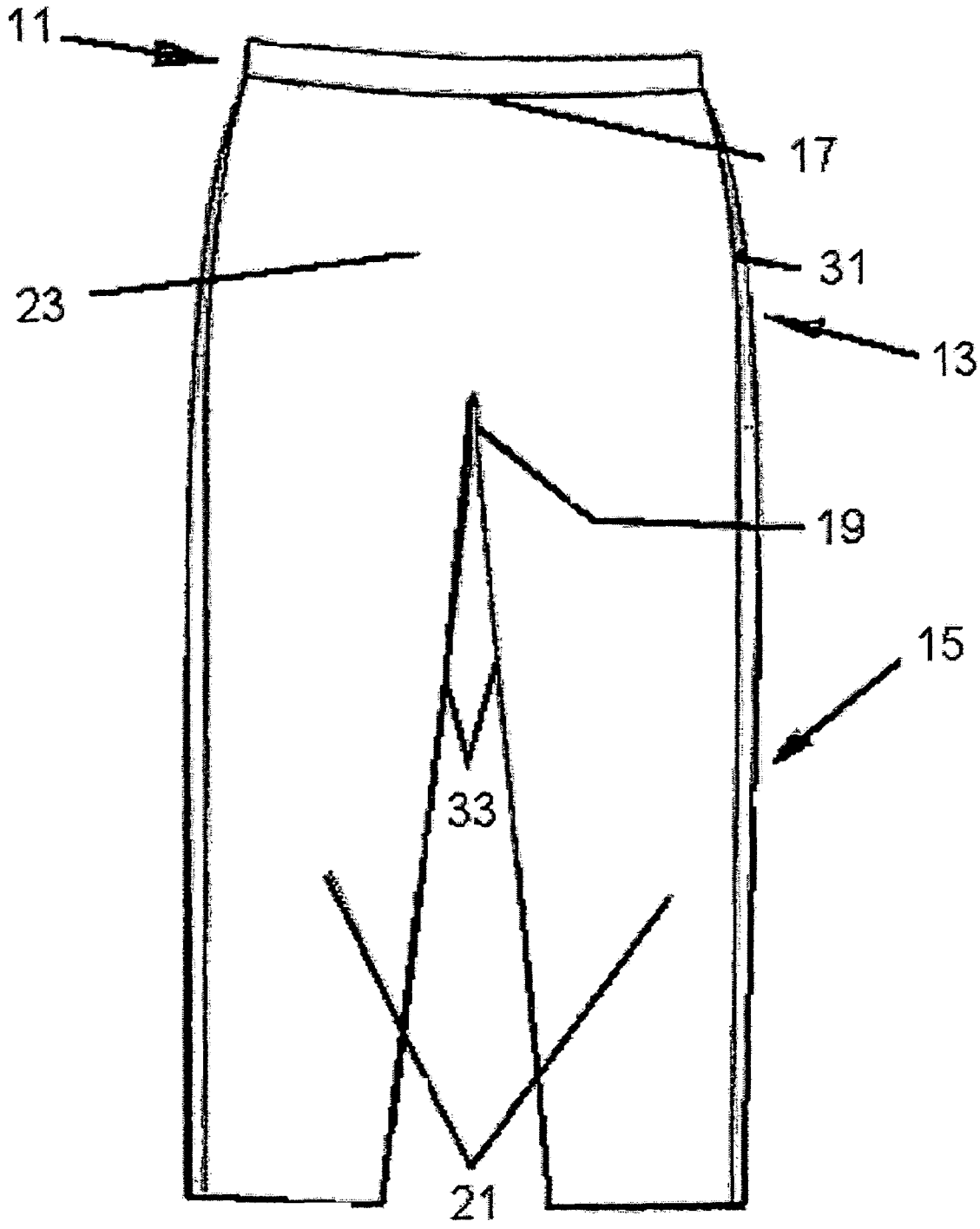
FIG. 2 is a front view of the garment of the present invention.

As further shown in FIG. 2, the waist 17 continues around to the front of the garment 11. The crotch 19 extends to the front side of the garment 11 as well. An abdomen area 23 is located between the waist 17 and crotch 19 on the front side of the garment. A zipper, button fly, or other fastener may be provided in the center of the abdomen area for securing the waist 17 around the waist of the wearer. The lower portion of the front side of the garment 11 includes the front portion of the pair of legs 21.

The front side of the garment 11 is attached to the rear side of the garment 11 from the waist to the bottom of the legs 21 by sewing means along the outer edges or sides of the front and rear sides, which will be referred to as outer side seams 31 shown. The front and rear sides are also attached via sewing means from the crotch 19 to the bottom of the legs 21 along inner edges or sides, which will be referred to as inner side seams 33.

FIGS. 3-7 show different embodiments of an elastic panel assembly 41. In each of these embodiments, the elastic panel assembly 41 is connected to the rear portion of the garment 11 at least at the waist 17 and the crotch 19, but may also be attached at its sides to the outer side seams 31. Thus, the lower edges of the elastic panel assembly 41 are not attached to any portion of the garment. The panel assembly 41 covers an inner surface of the rear portion over the seat area 16.

Figure 3:
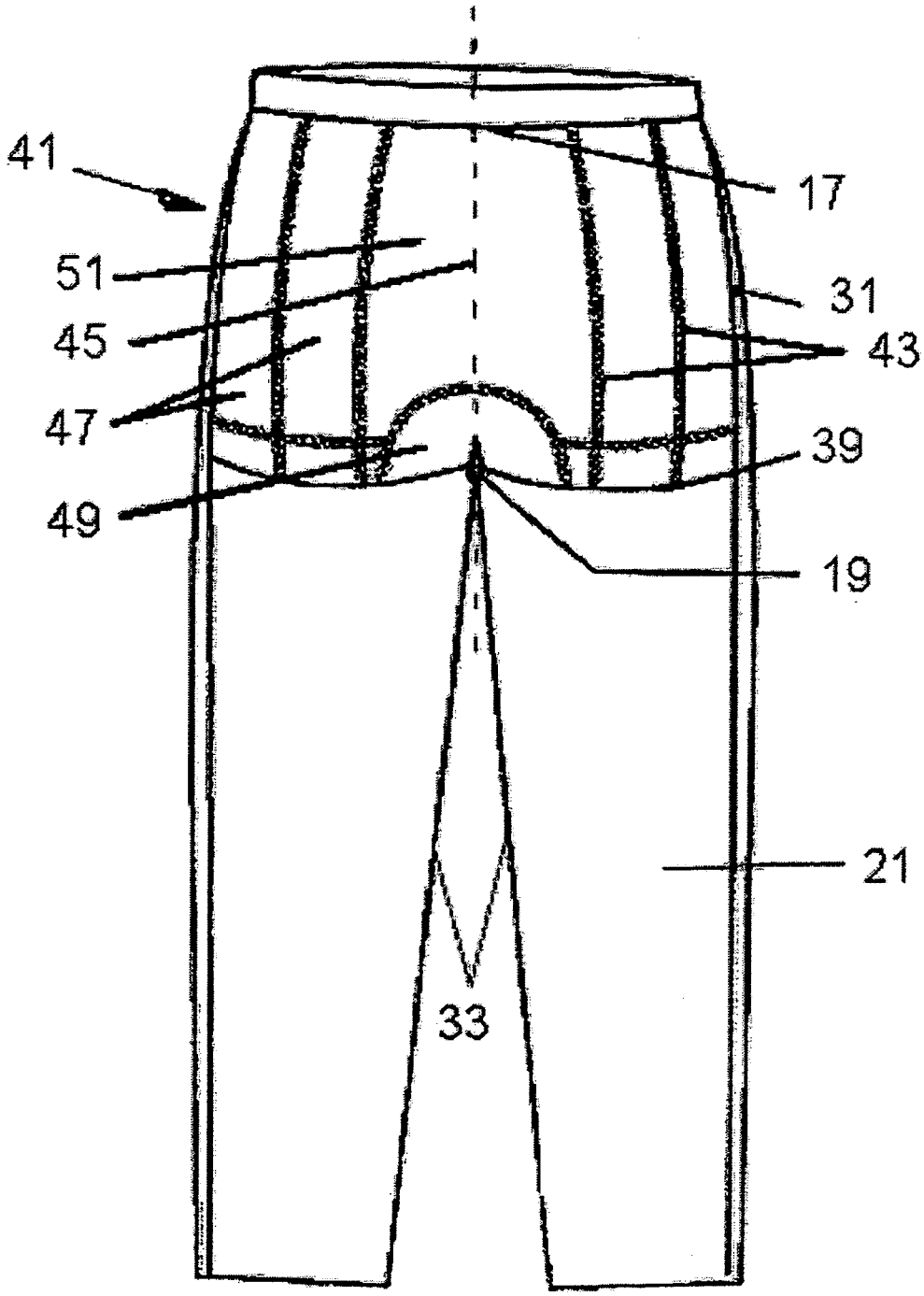
FIG. 3 is a rear view of the garment having an elastic panel assembly with two sets of substantially vertical seams on opposite sides of a vertical center axis.
Figure 4:
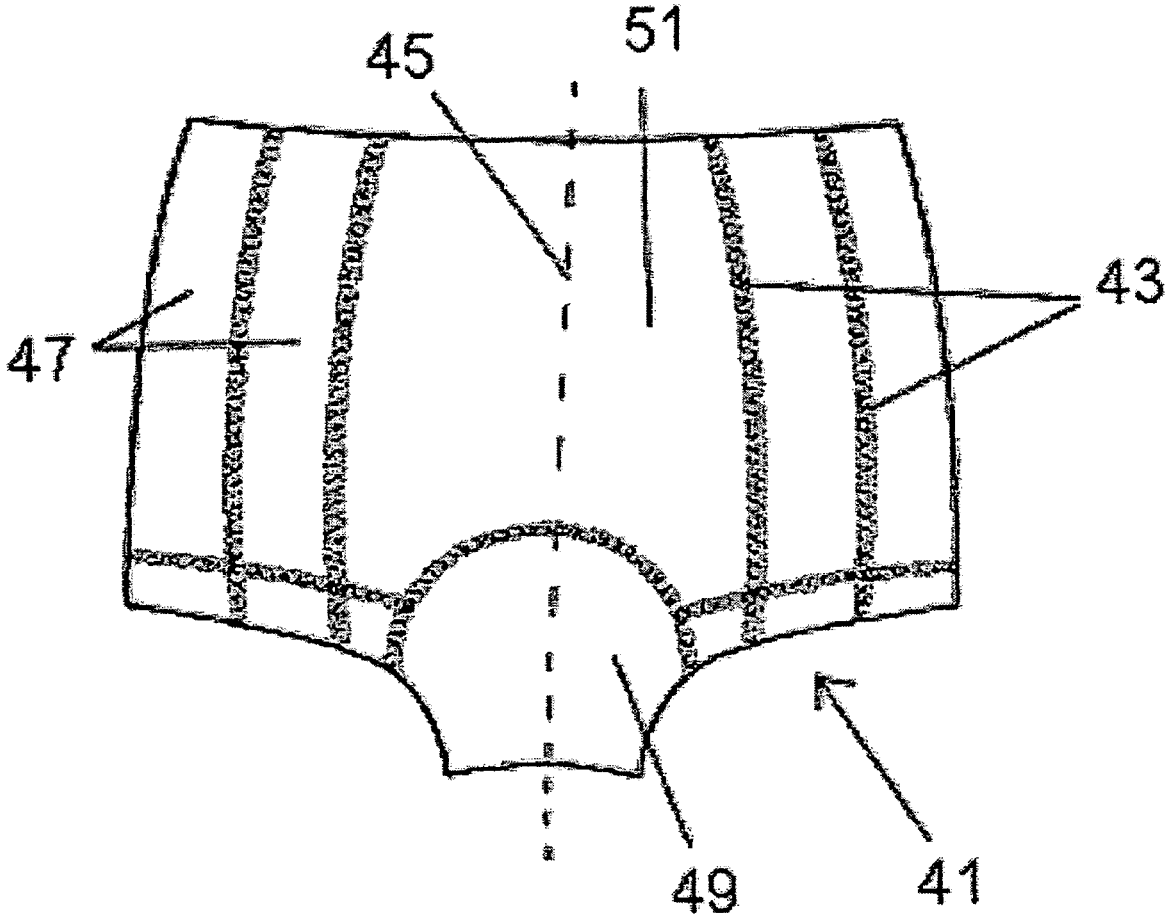
FIG. 4 is a drawing of the elastic panel assembly in FIG. 3.

The elastic panel assembly 41 shown in FIGS. 3 and 4 comprises two sets of two substantially vertical seams 43 spaced symmetrically on opposite sides of a vertical center axis 45 of the rear portion for defining two vertical upper elastic panels 47 on each side of the axis 45 that are connected to the waist 17, and an elastic lower panel 49 connected to the crotch 19. The substantially vertical seams 43 are curved. The two seams 43 of each respective set are curved in the same direction with respect to each other. However, the seams 43 in a set on one side of the center axis are curved in a direction opposite to a direction of curvature of the seams of the set on the opposite side of the center axis 45. In between the two sets of seams 43 is a center panel 51. Thus, there are a total of six separate panels in the panel assembly 41 of this embodiment.

A method for making the panel assembly 41 involves individually cutting and sewing six pieces together for forming the six panels and then sewing the assembly into the garment. The individual steps of the method are as follows. In the first step, fabric is cut from a pattern of the desired elastic panel assembly. In the second step, the cut fabric pieces are joined together using a single needle sewing machine making sure the seam allowance is folded toward the center back. In the third step, after the seams are joined together, all the seams are stitched over using a 3 thread Coverstitch machine. The row 3 thread cover stitch is stitched 1½" from the leg opening, from the side seam to the elastic lower panel 49. In the next step, the elastic panel assembly is sewn into the garment. When joining the side seams of the garment, the elastic panel assembly is to be sewn together with the side seams of the garment so that they are all one joined together by one operation. When joining the inseam of the garment, a seam of the lower panel of the elastic panel assembly should be joined centered over the crotch seam so that the elastic panel assembly and the inseam are joined together by one operation. The lower edges of the elastic panel assembly at the leg openings are left loose and not attached to any part of the garment. The waist edge of the elastic panel assembly should be joined together with the edge of the waist on the garment by a single needle machine before applying the waist of the garment to the body.

Figure 5:
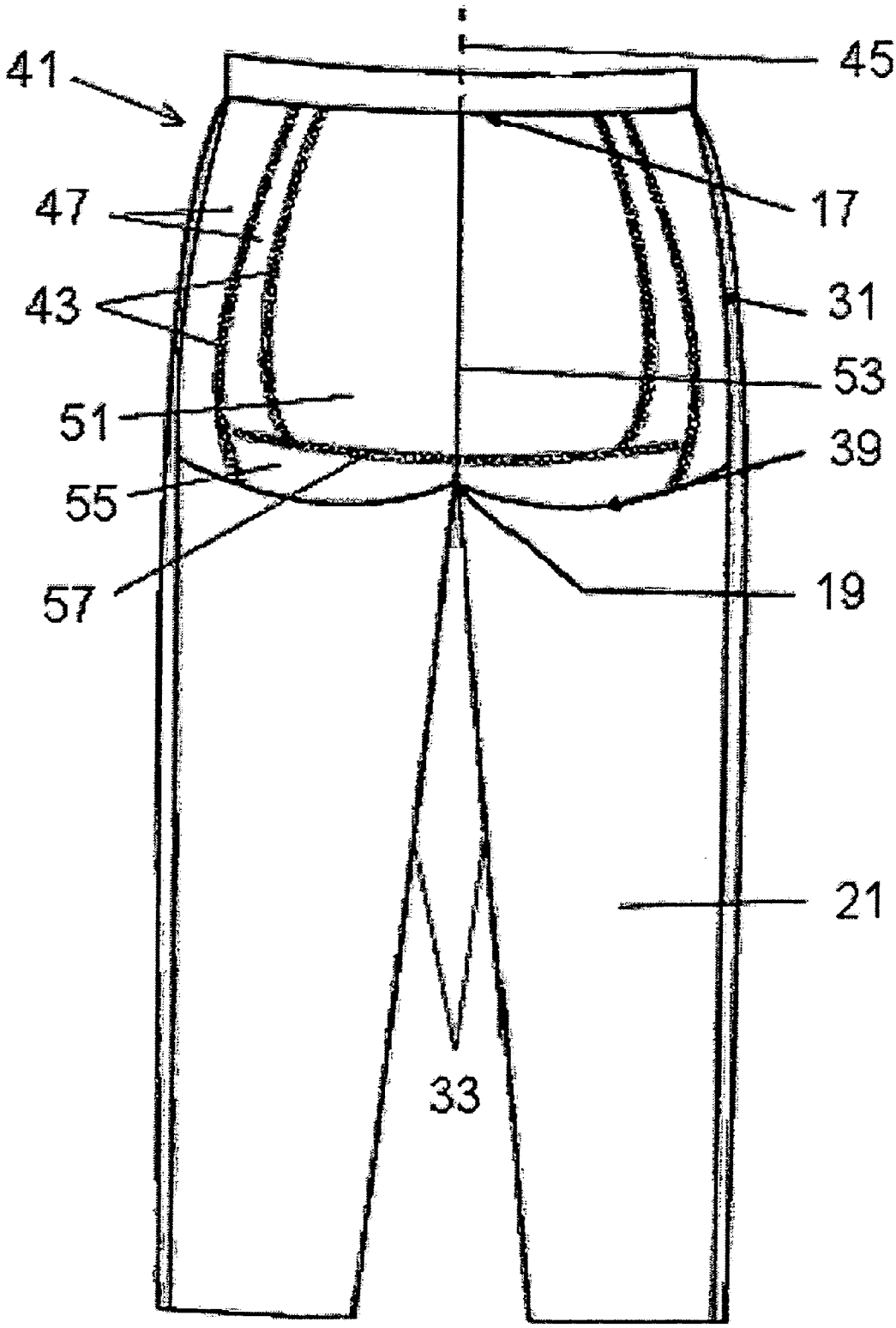
FIG. 5 is a rear view of the garment having an elastic panel assembly with substantially vertical seams and a substantially horizontal seam.

FIG. 5 shows an elastic panel assembly 41 which comprises two sets of two substantially vertical seams 43 spaced symmetrically on opposite sides of a vertical center axis 45 of the rear portion for defining a set of two vertical elastic upper panels 47 on each side of the axis 45 that are connected to the waist 17. A vertical seam 53 coincides with the vertical center axis 45 which divides the panel assembly 41 into left and right sides. The panel assembly 41 includes two lower and substantially horizontal elastic panels 55 on opposite sides of the seam 53, wherein each substantially horizontal elastic panel is connected by a substantially horizontal seam 57 to a lower end of an innermost vertical upper panel 47 of each respective set of vertical upper panels 47. The lower and substantially horizontal elastic panels 55 are connected to the crotch 19. In between the two sets of seams 43 are center panels 51. Thus, there are a total of eight separate panels in the panel assembly 41 of this embodiment.

Figure 6:
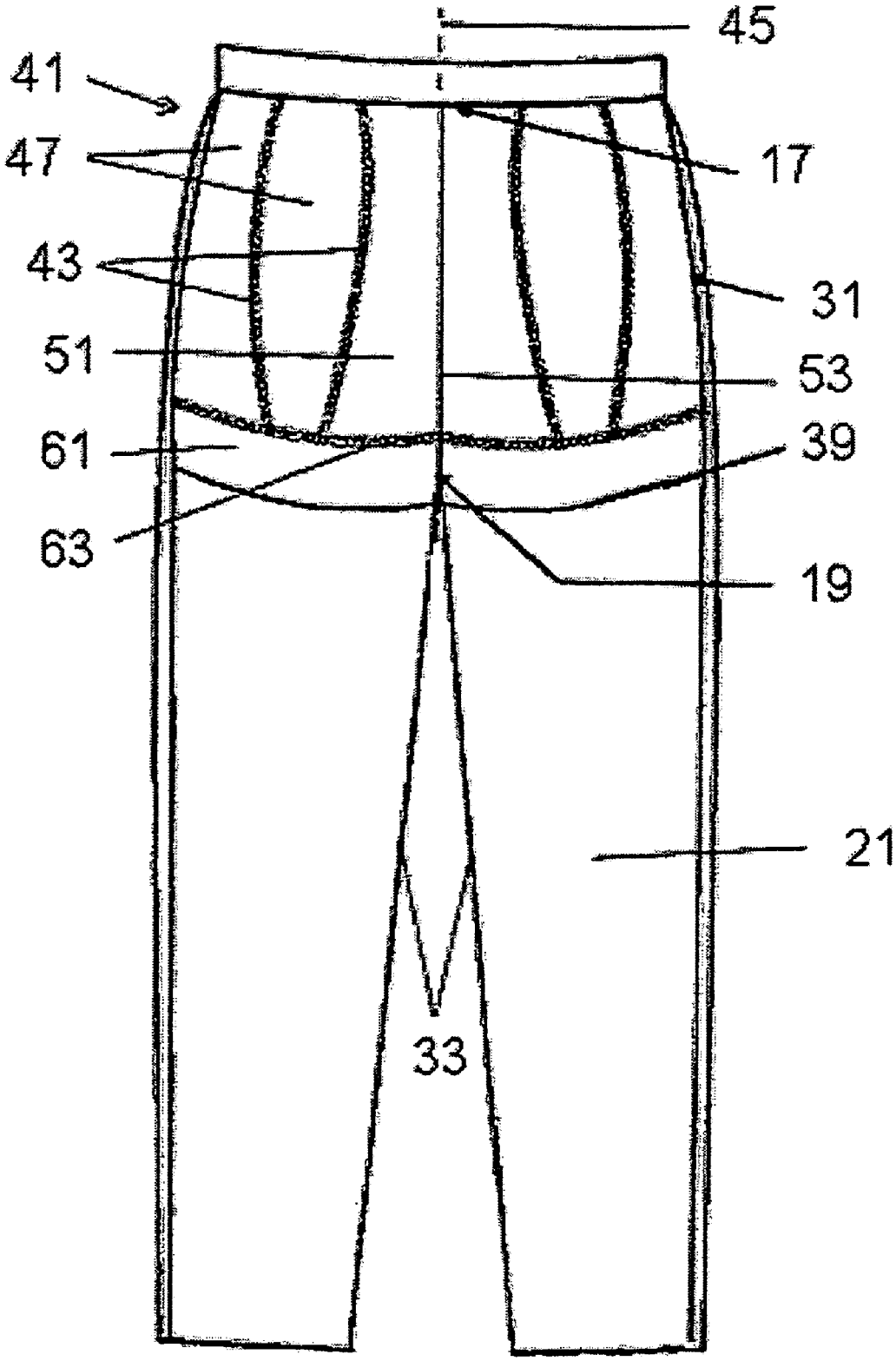
FIG. 6 is a rear view of another embodiment of a garment having an elastic panel assembly with substantially vertical seams and a substantially horizontal seam.

FIG. 6 shows an elastic panel assembly 41 which comprises two sets of two substantially vertical seams 43 spaced symmetrically on opposite sides of a vertical center axis 45 of the rear portion for defining two vertical elastic upper panels 47 on each side of the center axis 45 that are connected to the waist 17. A vertical seam 53 coincides with the vertical center axis 45 which divides the panel assembly 41 into left and right sides. The panel assembly 41 includes two lower and substantially horizontal elastic panels 61 on opposite sides of the seam 53, wherein each substantially horizontal elastic panel 61 is connected by a substantially horizontal seam 63 to a lower end of vertical upper panels 47. The lower and substantially horizontal elastic panels 61 are connected to the crotch 19. The substantially vertical seams 43 are curved. The two seams 43 of each respective set are curved in opposite directions with respect to each other. The seams 43 in a set on one side of the center axis are curved in a direction opposite to a direction of curvature of the seams of the set on the opposite side of the center axis 45. In between the two sets of seams 43 are center panels 51. Thus, there are a total of eight separate panels in the panel assembly 41 of this embodiment.

Figure 7:
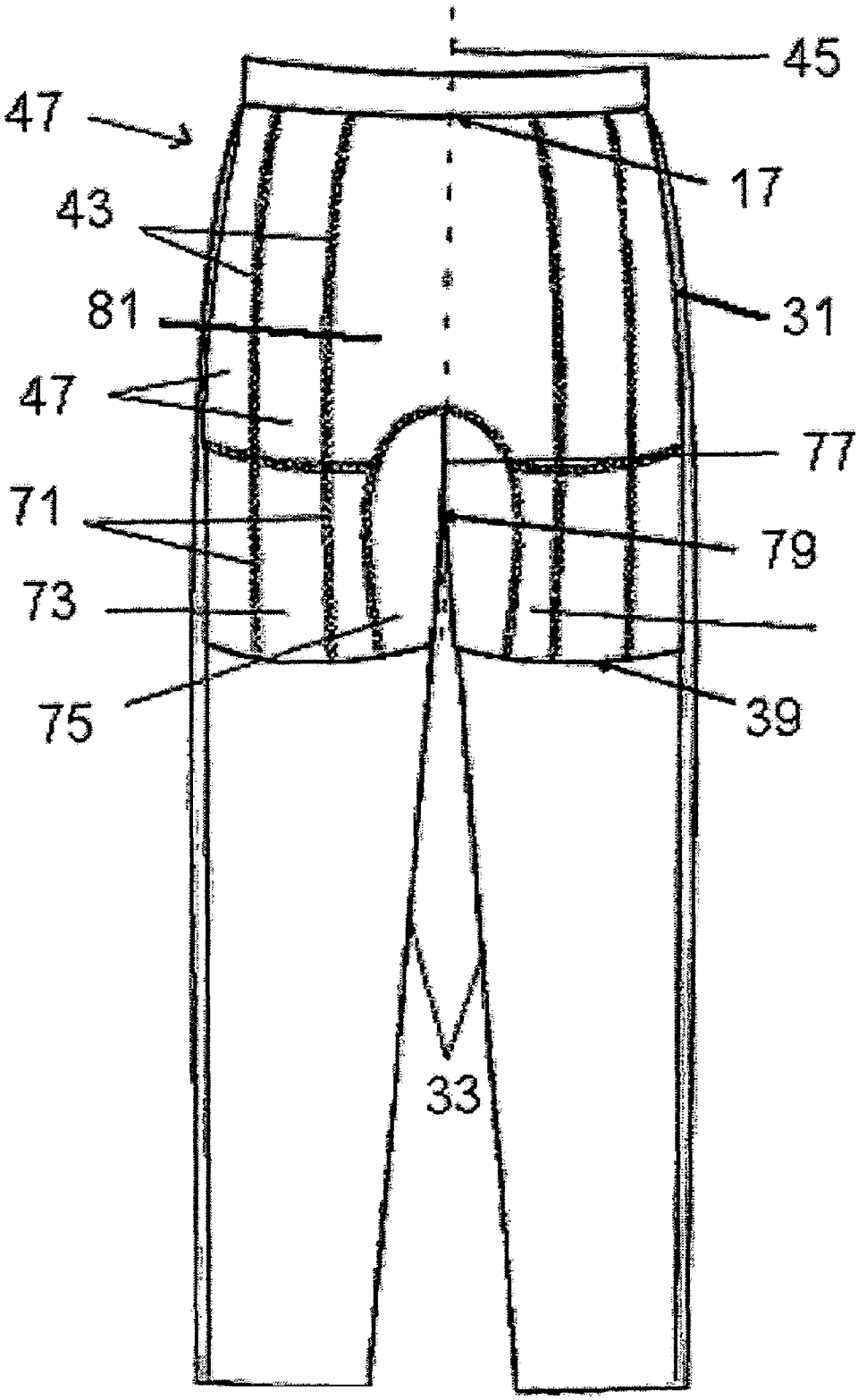
FIG. 7 is a rear view of another embodiment of a garment having an elastic panel assembly with two sets of two substantially vertical upper seams, two sets of two substantially vertical lower seams, and a substantially horizontal seam separating the upper and lower vertical seams.

FIG. 7 shows an elastic panel assembly 41 which comprises two sets of two substantially vertical seams 43 spaced symmetrically on opposite sides of a vertical center axis 45 of the rear portion for defining two vertical elastic upper panels 47 on each side of the axis 45 that are connected to the waist 17. The elastic panel assembly 41 further comprises two sets of plural substantially vertical lower seams 71 spaced symmetrically on opposite sides of vertical center axis 45 of the rear portion for defining at least two vertical elastic lower panels 73 on each side of the center axis 45 that are connected to, and extend below the vertical elastic upper panels 47 on opposite sides of vertical center axis 45. Lower panels 75 lie on opposite sides of the center axis 45 between opposite sets of elastic lower panels 73. Lower panels 75 are also separated by a vertical seam 77. Each lower panel 75 is attached to the crotch 19. A set of lower panels 79 are provided between the lower panels 75 and the set of vertical elastic lower panels 73. In between the two sets of seams 43 is a center panel 81. Thus, there are a total of thirteen separate panels in the panel assembly 41 of this embodiment.

FIGS. 8-14 show variations of a front elastic panel assembly generally designated 101. The front elastic panel assembly 101 is connected to the elastic assembly 41 at opposite outer side seams 31 of the garment 11 and extends over an inner surface of the front portion of the garment 11. The front elastic panel assembly 101 is connected to the front portion of the garment 11 at the waist 17. The lower edges of the elastic panel assembly 101 are not attached to any portion of the garment. The front portion of the garment has a central fastener area (e.g., a zipper area) and the front elastic panel 101 may additionally be connected to the front garment portion on opposite sides of the fastener area.

Figure 8:
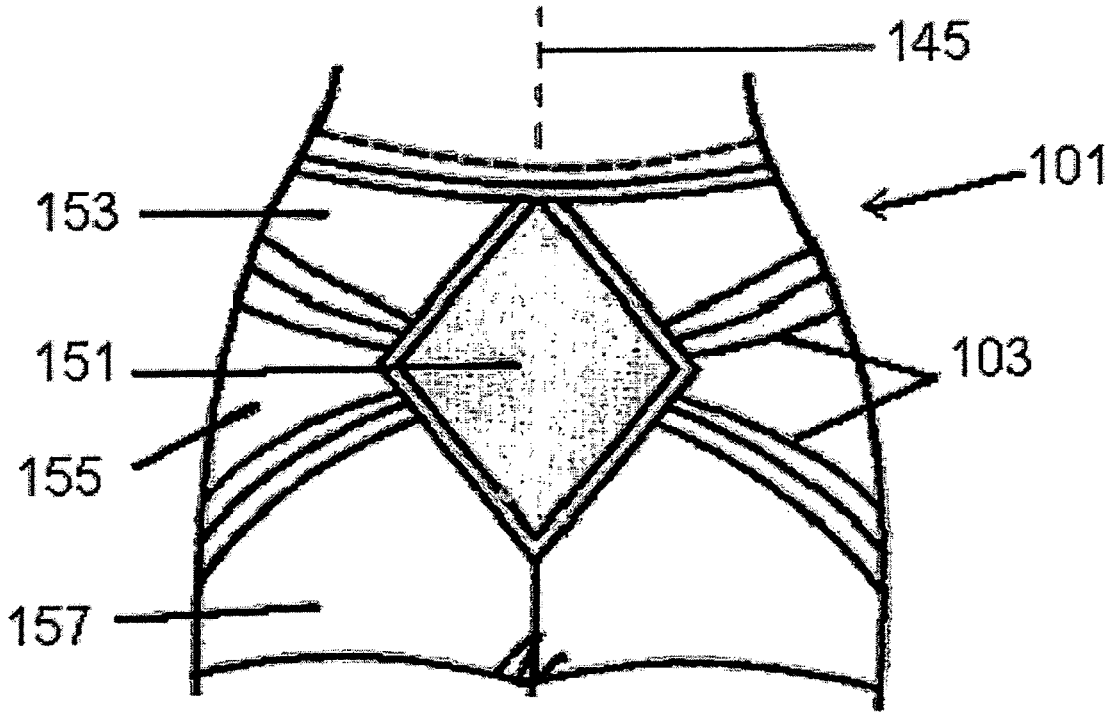
FIG. 8 is a front elastic panel assembly with two sets of transverse seams on opposite sides of a vertical center axis converging onto a center panel.

The front elastic panel assembly 101 shown in FIG. 8, comprises two sets of three transverse curved seams 103 on each side of a vertical center axis 145. The two sets of three seams 103 on each respective side of the vertical center axis 145 diverge from each other in a direction toward the outer side seam 31. The two sets of three seams 103 on each respective side of the vertical center axis 145 converge toward the center at a diamond shaped panel 151, defining upper panel 153, intermediate panel 155, and lower panel 157. The two sets of three seams 103 on each side of the vertical center axis 145 are symmetrical to each other and to the two sets of seams on an opposite side of the vertical center axis 145. The diamond shaped panel 151 has less elasticity than the three panels 153, 155, and 157. The upper panels 153 are attached to the waist. The lower panels 157 are not attached to the garment and hang freely simulating a girdle. Thus, there are a total of seven separate panels in the panel assembly 101 of this embodiment.

Figure 9:
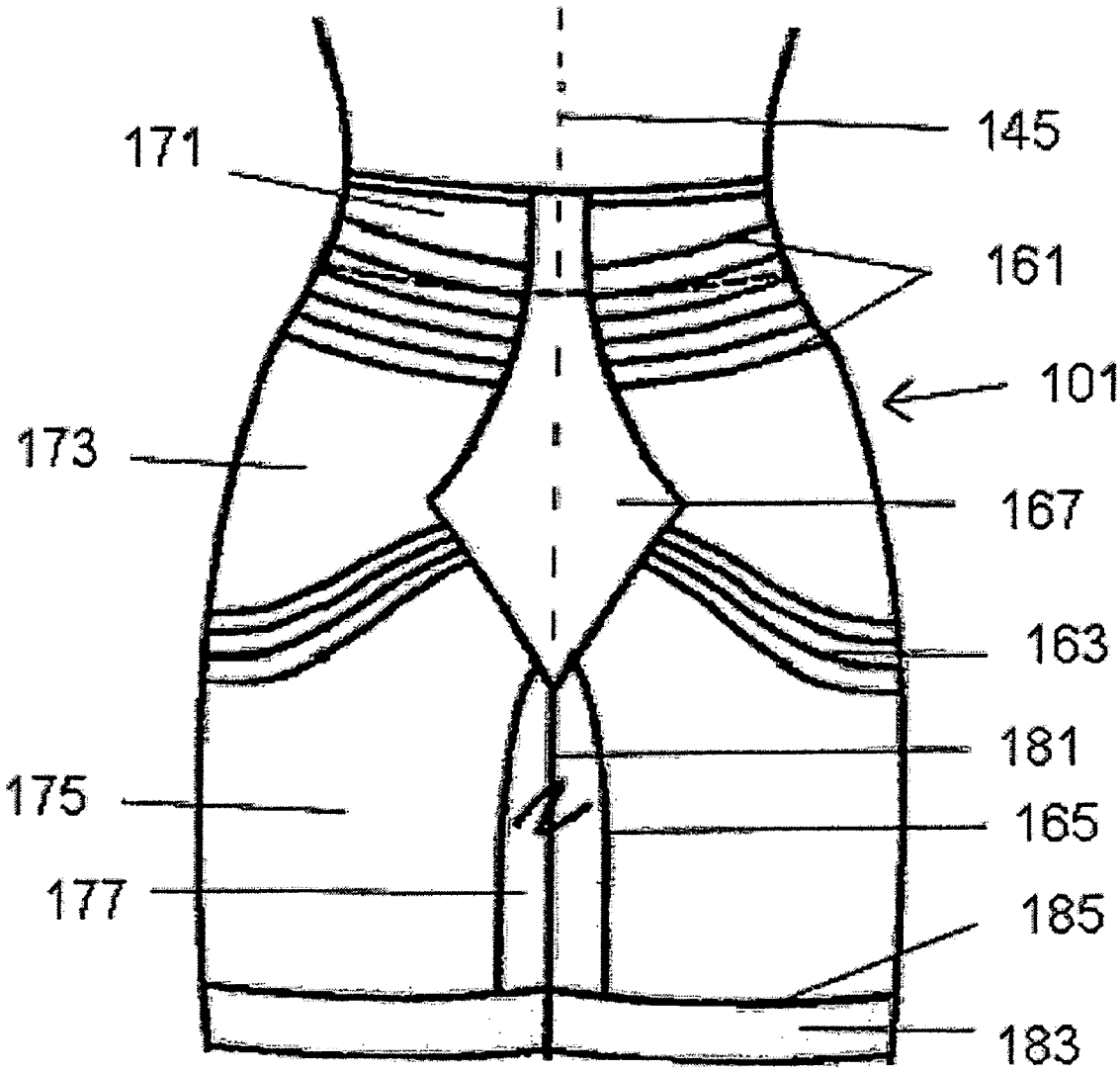
FIG. 9 is a front elastic panel assembly with two sets of transverse seams on opposite sides of a vertical center axis meeting a center panel, a substantially vertical lower seam on opposite sides of a vertical center axis below the center panel, and a substantially horizontal lower seam on opposite sides of a vertical center axis below the vertical lower seam.

The front elastic panel assembly 101 shown in FIG. 9, comprises an upper set of six transverse seams 161, an intermediate lower set of four transverse seams 163, and a lower substantially vertical seam 165 on each side of a vertical center axis 145. The three sets of seams 161, 163, 165 on each respective side of the vertical center axis 145 meet at a diamond shaped panel 167 at the center of the panel assembly 101, defining upper panel 171, intermediate panel 173, and two adjacent lower panels 175 and 177. The diamond shaped panel 167 has less elasticity than the four panels 171, 173, 175, and 177. The upper panels 171 are attached to the waist.

The front elastic panel assembly 101 also comprises one vertical seam 181 overlapping the center axis 145. The panel assembly 101 includes two lower and substantially horizontal elastic panels 183 on opposite sides of the seam 181, wherein each substantially horizontal elastic panel 183 is connected by a substantially horizontal seam 185 to a lower end of lower panels 175 and 177. The horizontal elastic panels 183 are not attached to the garment and hang freely simulating a girdle. Thus, there are a total of eight separate panels in the panel assembly 101 of this embodiment.

Figure 10:
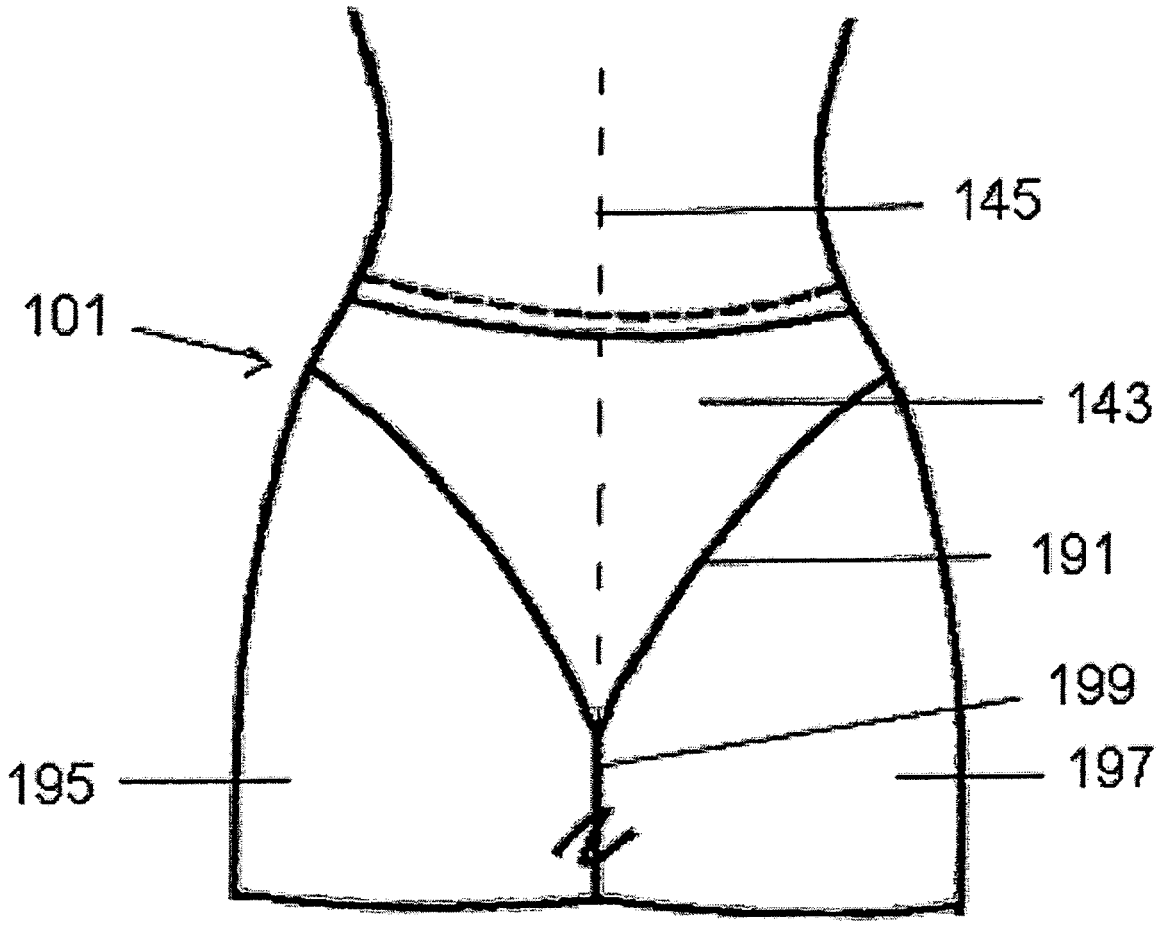
FIG. 10 is a front elastic panel assembly with two transverse seams on opposite sides of a vertical center axis which converge at the vertical center axis to form an upper V-shaped panel, wherein a substantially vertical seam overlapping the vertical center axis below the upper V-shaped panel forms two lower panels.

The front elastic panel assembly 101 shown in FIG. 10, comprises two transverse seams 191 which converge at the vertical center axis 145 to form a V-shaped upper panel 193 and opposite symmetrical lower panels 195 and 197 which are separated by a vertical seam 199. The upper panel 193 is attached to the waist 17. The lower panels 195 and 197 are not attached to the garment 11 and therefore hang freely simulating a girdle. Thus, there are a total of three separate panels in the panel assembly 101 of this embodiment.

Figure 11:
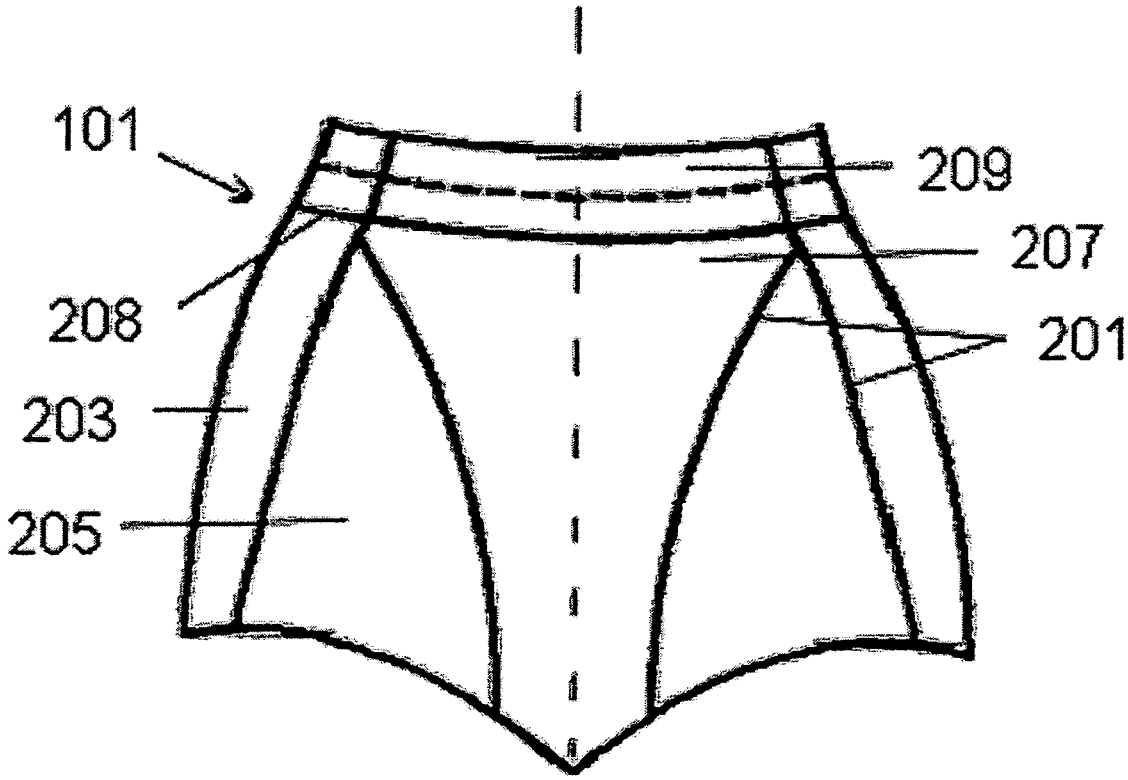
FIG. 11 is a front elastic panel assembly with two sets of substantially vertical seams spaced symmetrically on opposite sides of a vertical center axis, and a substantially horizontal seam near the waist.

FIG. 11 shows a front elastic panel assembly 101 which comprises two sets of two substantially vertical seams 201 spaced symmetrically on opposite sides of a vertical center axis 145 of the front portion for defining vertical elastic panels 203 and 205 on each side of the axis 145. In between the two sets of seams 201 is a center panel 207. The two seams 201 of each respective set are curved toward to each other. The panel assembly 101 also includes one substantially horizontal upper seam 208, and a horizontal panel 209 connected to the upper edge of the panel 207 by the seam 208 near the waist 17.

Figure 12:
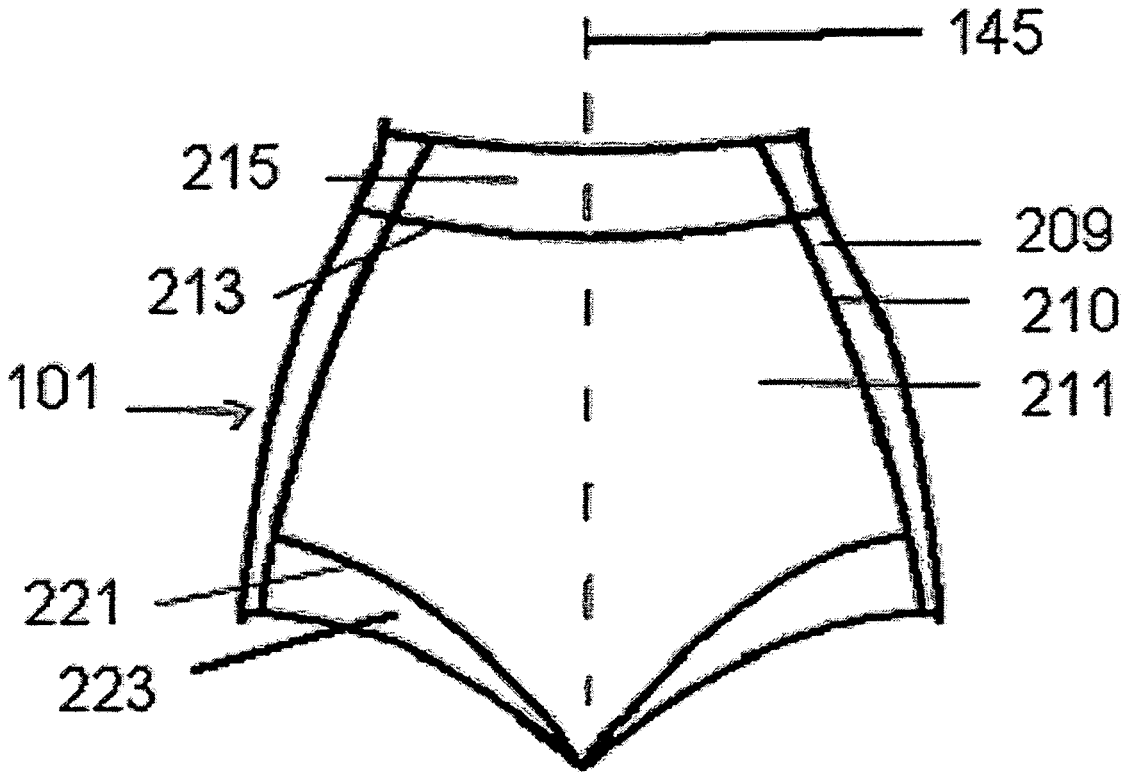
FIG. 12 is a front elastic panel assembly with substantially vertical seams spaced symmetrically on opposite sides of a vertical center axis, a substantially horizontal seam near the waist, and transverse seams near the crotch spaced symmetrically on opposite sides of a vertical center axis.

FIG. 12 shows a front elastic panel assembly 101 which comprises one substantially vertical seam 210 spaced symmetrically on opposite sides of a vertical center axis 145 of the front portion for defining a vertical elastic panel 209 on each side of the axis 145. A panel 211 is provided between the vertical seams 210 of the opposite sides of the assembly 101. The panel assembly 101 also includes one substantially horizontal upper seam 213, and a horizontal panel 215 connected to the upper edge of the panel 211 by the seam 213 near the waist 17. The panel assembly 101 further includes a transverse seam 221 spaced symmetrically on opposite sides of a vertical center axis 145 of the front portion. Lower transverse panels 223 are connected to the lower edges of the panel 211 via the transverse seam 221.

Figure 13:
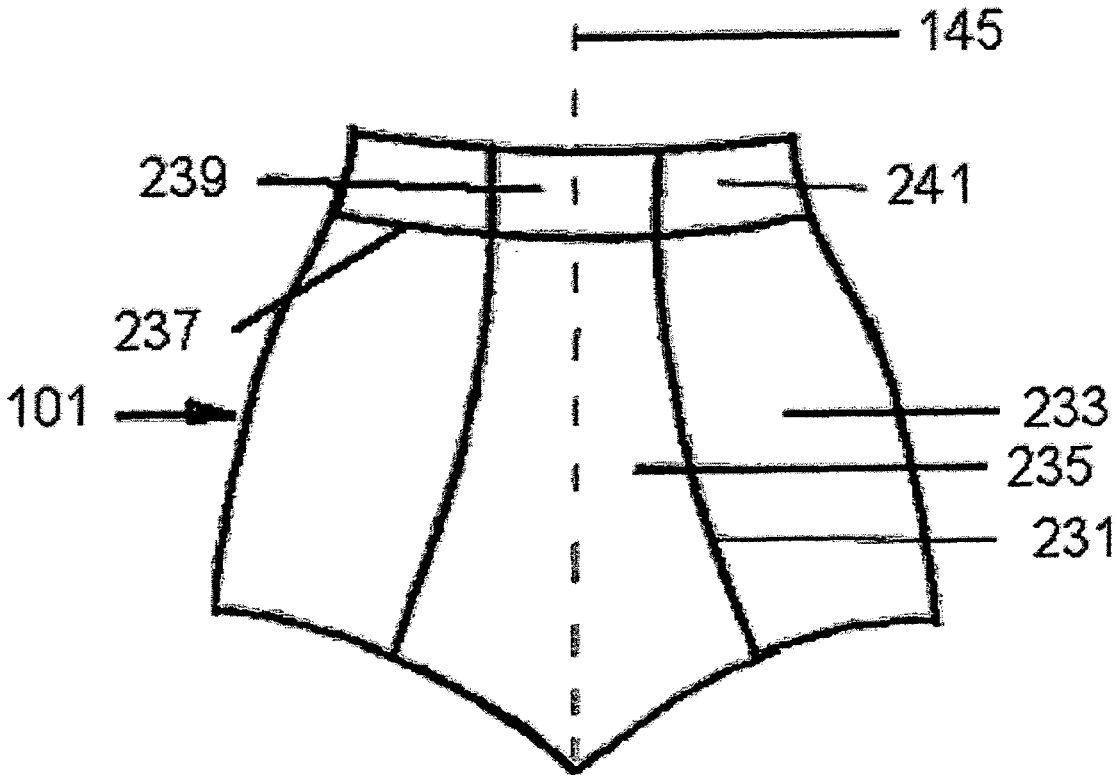
FIG. 13 is a front elastic panel assembly with substantially vertical seams spaced symmetrically on opposite sides of a vertical center axis, and a substantially horizontal seam near the waist.

As shown in FIG. 13, the panel assembly 101 comprises substantially vertical seams 231 spaced symmetrically on opposite sides of a vertical center axis 145 of the front portion for defining a vertical elastic panel 233 on each side of the axis 145. A panel 235 is provided between the vertical seams 231 of the opposite sides of the assembly 101. The panel assembly 101 also includes one substantially horizontal upper seam 237, and a horizontal panel 239 connected to the upper edge of the panel 235 by the seam 237 near the waist 17. A separate upper panel 241 is also formed on opposite sides of the panel 101 due to the intersection of the substantially vertical seam 231 and the substantially horizontal upper seam 237.

Figure 14:
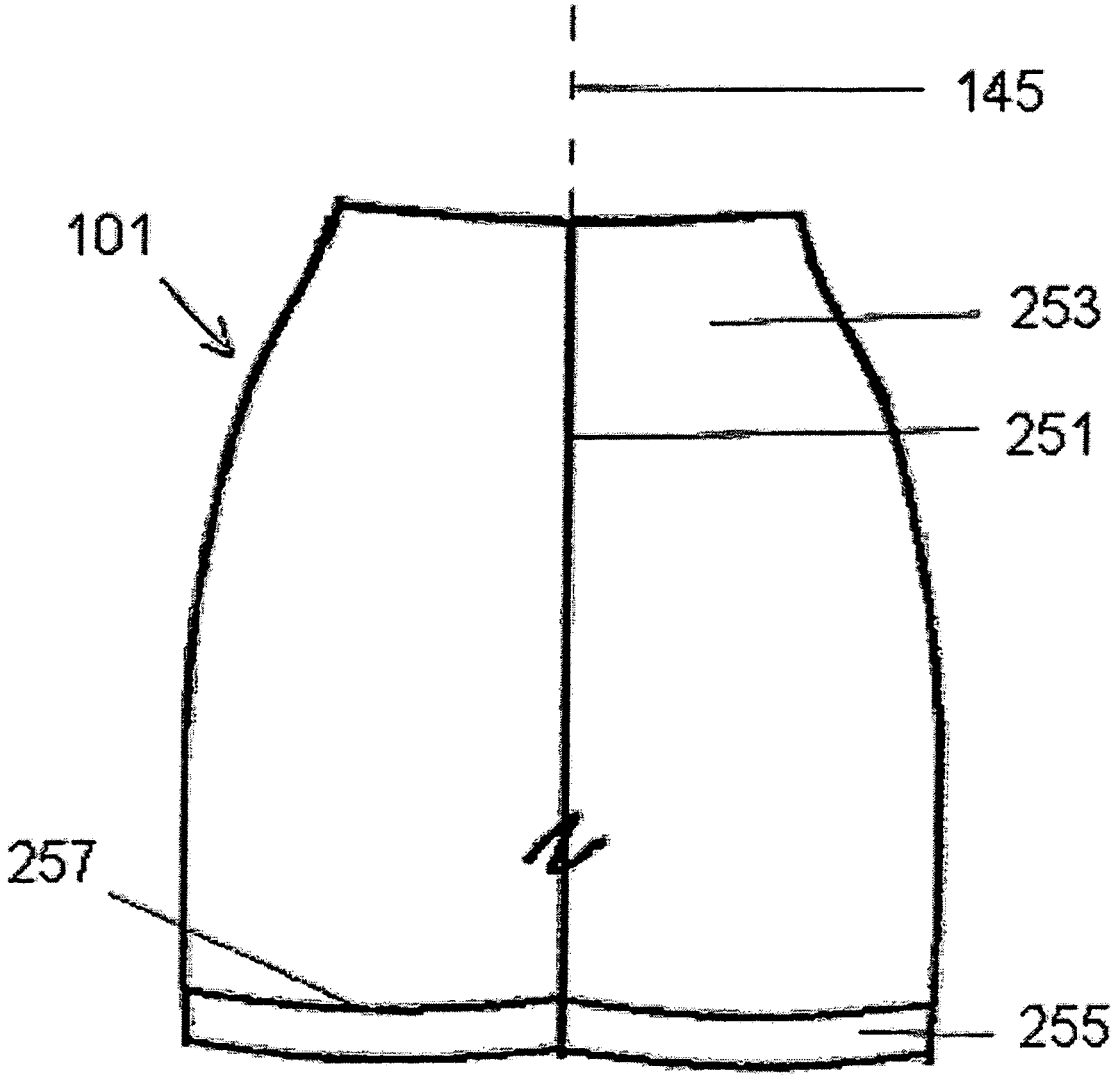
FIG. 14 is a front elastic panel assembly with a substantially vertical seam overlapping the vertical center axis and a substantially horizontal seam on opposite sides of the vertical center axis.

As shown in FIG. 14, the front elastic panel assembly 101 comprises one vertical seam 251 overlapping the center axis 145 for defining a vertical upper panel 253 on each side of the axis 145 that is connected to the waist 17. The panel assembly 101 includes two lower and substantially horizontal elastic panels 255 on opposite sides of the seam 251, wherein each substantially horizontal elastic panel 255 is connected by a substantially horizontal seam 257 to a lower end of vertical upper panels 253.

There are several ways for accentuating a lifting effect of the rear of the garment 11. The garment 11 is can be made of stretch denim or similar stretchable material like that described in U.S. Pat. Nos. 5,535,451, 5,645,924, and 4,283,194. The elastic panel assembly 41 and/or 101 is preferably made of a stretchable and elastic fabric such as power net or a blend of spandex and nylon, which stretches horizontally and vertically. Tables 1 and 2 below show an exemplary type of fabric and the stretch, recovery and power attributes of that preferred fabric.

TABLE 1

| Fabric Specification | |
|---|---|
| Qual: | GTX8334 |
| Content: | 68% Nylon 32% Spandex |
| Yarn Count: | Nylon 40 D/48 F + Spandex 40 D |
| Weight: | 320 g |
| Width: | 64" |
| Machine: | Tricot |
| Gauge: | 32 G |
| WPI: | 59 |
| CPI: | 56 |

TABLE 2

| stretch, recovery, and power attributes | Length | Width |
|---|---|---|
| Elongation | 148% | 148% |
| Recovery | 96% | 96% |
| Modulus @ 40% | 1.45 | 0.80 |
| Modulus @ 60% | 2.15 | 1.49 |
| Modulus @ 80% | 2.88 | 2.28 |

The garment 11 can be manufactured such that the stretch fabric of at least some of the panels of the panel assembly 41 stretch more horizontally than vertically for applying a lifting effect to the seat area of the garment. The front waistband seam may be curved shorter than the rear waistband seam such that the front of the garment is lower than the rear of the garment, thereby accentuating the lifting effect to the seat area of the garment.

The pants or jeans of the present invention can be manufactured in a variety of styles such as boot cut, low on waist, sexy fit and/or slim fit.

Although the above exemplary embodiments of the present invention show a specific number of horizontal, vertical, or transverse seams, additional seams may be provided to increase the number of separate panels.

While specific embodiments of the invention have been shown and described in detail to illustrate the application of the principles of the invention, it will be understood that the invention may be embodied otherwise without departing from such principles.

What is claimed is:

1. A garment with a seat area, a waist area and a crotch area, the garment comprising:

a rear portion defining the seat area and part of the waist area and being bounded at the bottom by the crotch area;

a front portion connected to the rear portion and defining part of the waist area and being bounded at the bottom by the crotch area; and an elastic panel assembly connected to the rear portion at least at the waist area and the crotch area, the panel assembly covering an inner surface of the rear portion over the seat area and comprising two sets of plural substantially vertical seams spaced symmetrically on opposite sides of a vertical center axis of the rear portion thereby defining at least two vertical elastic upper panels on each side of the center axis that are connected to the waist area, and at least one elastic lower panel being connected to the crotch area.

2. A garment according to claim 1, wherein the rear and front portions are connected to each other at a pair of opposite side seams, the elastic panel assembly having opposite side edges connected to the respective opposite side seams and a pair of lower edges on opposite sides of the center axis that are free and are not connected to the rear portion of the garment on either side of the crotch area.

3. A garment according to claim 1, wherein each set of substantially vertical seams contains two seams.

4. A garment according to claim 3, wherein each substantially vertical seam is curved and the seams in each set are curved in the same direction and opposite to a direction of curvature of the seams of the set on the opposite side of the center axis.

5. A garment according to claim 4, wherein the two curved seams in each set diverge from each other in a direction away from the waist area.

6. A garment according to claim 3, wherein each substantially vertical seam is curved and the seams in each set are curved in opposite directions.

7. A garment according to claim 1, wherein the panel assembly includes at least one lower and substantially horizontal elastic panel connected by at least one substantially horizontal seam to a lower end of at least one of the vertical elastic upper panels.

8. A garment according to claim 7, wherein the rear and front portions are connected to each other at a pair of opposite side seams, the elastic panel assembly having opposite side edges connected to the respective opposite side seams and a pair of lower edges on opposite sides of the center axis that are free and are not connected to the rear portion of the garment, the substantially horizontal elastic panel and substantially horizontal seam being on opposite sides of the elastic lower panel connected to the crotch area.

9. A garment according to claim 1, wherein the at least one lower panel is connected to at least one of the vertical elastic upper panels on each side of the center axis at a substantially horizontal seam.

10. A garment according to claim 1, wherein the elastic panel assembly further comprises two sets of plural substantially vertical lower seams spaced symmetrically on opposite sides of a vertical center axis of the rear portion for defining at least two vertical elastic lower panels on each side of the center axis that are connected to, and extend below the vertical elastic upper panels on opposite sides of the elastic lower panel connected to the crotch area.

11. A garment according to claim 1, further comprising a front elastic panel assembly connected to the rear elastic panel assembly at opposite side seams of the garment and extending over at least part of an inner surface of the front portion of the garment, the side seams connecting the rear and front portions to each other.

12. A garment according to claim 11, wherein the front elastic panel assembly has a pair of lower edges on opposite sides of a vertical center axis that are free and are not connected to the front portion of the garment.

13. A garment according to claim 11, wherein the front elastic panel assembly comprises two sets of plural transverse seams arranged symmetrically on opposite sides of a vertical center axis of the front portion and meeting a center panel for defining a plurality of panels on each side of the center panel, wherein the center panel has less elasticity than the outer panels.

14. A garment according to claim 13, further comprising one vertical seam on opposite sides of a vertical center axis beneath said center panel for defining at least one additional lower panel, wherein at least one lower and substantially horizontal elastic panel is arranged beneath said additional lower panel.

15. A garment according to claim 11, wherein the front elastic panel assembly comprises transverse seams arranged symmetrically on opposite sides of a vertical center axis of the front portion and converging at a vertical center axis to form a V-shaped panel.

16. A garment according to claim 11, wherein the front elastic panel assembly comprises one or more substantially vertical seams spaced symmetrically on opposite sides of a vertical center axis of the front portion for defining one or more vertical elastic panels on each side of the center axis.

17. A garment according to claim 16, wherein the front elastic panel assembly further comprises at least one upper and substantially horizontal elastic panel connected by at least one substantially horizontal seam to an upper end of at least one of the vertical panels or a panel between the vertical panels.

18. A garment according to claim 11, wherein the front elastic panel assembly comprises at least one lower and transverse elastic panel on each side of a vertical center axis.

19. A garment according to claim 11, wherein the front elastic panel assembly comprises at least one lower and substantially horizontal elastic panel on each side of a vertical center axis.

20. A garment according to claim 1, wherein at least one of the rear and front portions are at least partly made of stretch denim material.

21. A garment according to claim 1, including a front elastic panel assembly connected to the rear elastic panel assembly at opposite sides of the garment and extending over at least part of an inner surface of the front portion of the garment, the front portion having a central fastener area and the front elastic panel being connected to the front portion on opposite sides of the central fastener area.

22. A garment according to claim 1, wherein each panel of the panel assembly is made of stretch fabric which stretches horizontally and vertically.

23. A garment according to claim 22, wherein the stretch fabric of at least some of the panels of the panel assembly stretch more horizontally than vertically for applying a lifting effect to the seat area of the garment.

* * * * *